US008079735B1

(12) United States Patent
Vakil et al.

(10) Patent No.: US 8,079,735 B1
(45) Date of Patent: Dec. 20, 2011

(54) LIGHT EMITTING DIODE ILLUMINATION DEVICE

(76) Inventors: Usman Vakil, Walnut, CA (US); Aijaz Taj, Walnut, CA (US); Brian Halliwell, Walnut, CA (US)

( * ) Notice: Subject to any disclaimer, the term of this patent is extended or adjusted under 35 U.S.C. 154(b) by 337 days.

(21) Appl. No.: 12/384,081

(22) Filed: Mar. 31, 2009

(51) Int. Cl.
*F21V 1/08* (2006.01)
*F21S 13/14* (2006.01)

(52) U.S. Cl. ..... 362/294; 362/235; 362/249.02

(58) Field of Classification Search ..... 362/294, 362/235, 373, 249.02–249.06, 547, 800
See application file for complete search history.

(56) References Cited

U.S. PATENT DOCUMENTS

| | | | | |
|---|---|---|---|---|
| 4,211,955 | A | 7/1980 | Ray | |
| 4,727,289 | A | 2/1988 | Uchida | |
| 5,561,346 | A | 10/1996 | Byrne | |
| 5,806,965 | A | 9/1998 | Deese | |
| 5,947,588 | A | 9/1999 | Huang | |
| 6,161,910 | A * | 12/2000 | Reisenauer et al. | 315/309 |
| 6,220,722 | B1 | 4/2001 | Begemann | |
| 6,227,679 | B1 * | 5/2001 | Zhang et al. | 362/236 |
| 6,357,893 | B1 | 3/2002 | Belliveau | |
| 6,499,860 | B2 | 12/2002 | Begemann | |
| 6,523,978 | B1 | 2/2003 | Huang | |
| 6,580,228 | B1 | 6/2003 | Chen et al. | |
| 6,621,222 | B1 | 9/2003 | Hong | |
| 6,659,632 | B2 | 12/2003 | Chen | |
| 6,709,132 | B2 | 3/2004 | Ishibashi | |
| 6,948,829 | B2 | 9/2005 | Verdes et al. | |
| 7,011,430 | B2 * | 3/2006 | Chen | 362/235 |
| 7,086,756 | B2 | 8/2006 | Maxik | |
| 7,160,012 | B2 | 1/2007 | Hilscher et al. | |
| 7,354,174 | B1 * | 4/2008 | Yan | 362/249.16 |
| 7,413,325 | B2 * | 8/2008 | Chen | 362/249.01 |
| 2004/0022057 | A1 * | 2/2004 | Lee | 362/238 |
| 2004/0114367 | A1 | 6/2004 | Li | |
| 2005/0213324 | A1 * | 9/2005 | Chen | 362/249 |
| 2007/0153518 | A1 * | 7/2007 | Chen | 362/252 |
| 2007/0195527 | A1 * | 8/2007 | Russell | 362/240 |

* cited by examiner

*Primary Examiner* — Bao Q Truong
(74) *Attorney, Agent, or Firm* — Kuta IP Law LLC; Christine M. Kuta

(57) ABSTRACT

A light emitting diode (LED) illumination device provides an arrangement of LEDs spaced from the base of the device. The LEDs are spaced in a staggered vertical arrangement. The configuration of LEDs manages heat such that brightness and lifespan are maximized. In addition, the arrangement of LEDs broadens the project area of the device.

15 Claims, 7 Drawing Sheets

LIGHT EMITTING DIODE ILLUMINATION DEVICE

BACKGROUND

Artificial lighting, that is, light generated using an energy source, represents a major component of energy consumption, accounting for a significant part of all energy consumed worldwide. Artificial lighting is commonly provided by lighting devices using electricity as the energy source.

Conventional lighting technology includes the incandescent light bulb, also referred to as the incandescent lamp. The incandescent light bulb works by incandescence, that is, an electrical current passes through a thin filament, heating the filament until it produces light. An enclosing glass bulb prevents the oxygen in air from reaching the hot filament, which otherwise would be destroyed rapidly by oxidation. Incandescent bulbs are made in a wide range of sizes and voltages, from 1.5 volts to about 300 volts. Incandescent bulbs typically require no external regulating equipment and have a low manufacturing cost, and work well on either alternating current or direct current. As a result, the incandescent light bulb is widely used in household and commercial lighting, for portable lighting, such as table lamps, some car headlamps and electric flashlights, and for decorative and advertising lighting.

Incandescent light bulbs, however, use light emission resulting from resistance. Therefore, a large amount energy in an incandescent bulb is lost in the form of heat energy. Accordingly, the energy efficiency of incandescent light bulbs is relatively low. Incandescent light bulbs are gradually being replaced in conventional lighting technology by more efficient lamps including compact fluorescent lamps (CFLs), which give more visible light for the same amount of electrical energy input.

A CFL, also known as a compact fluorescent light bulb (or less commonly as a compact fluorescent tube (CFT)) is a type of gas discharge lamp. Many CFLs are designed to replace an incandescent lamp and include the standard base enabling the CFL to fit in existing light fixtures formerly used for incandescents.

Compared to incandescent lamps of the same luminous flux (i.e. luminous power), CFLs use less energy and have a longer rated life. For a given light output, CFLs use between one fifth and one quarter of the power of an equivalent incandescent lamp. A CFL can therefore significantly save electricity costs over the lamp's lifetime compared to an incandescent lamp. A CFL can also can save 2000 times its own weight in greenhouse gases due to its energy efficiency. While CFLs radiate a different light spectrum from that of incandescent lamps, improved phosphor formulations have improved the subjective color of the light emitted by CFLs such that some CFLs are subjectively similar in color to standard incandescent lamps.

As efficient as a CFL is over an incandescent lamp, the CFL also loses a significant amount of energy as heat energy. Fluorescent lamps pollute the environment when disposed of because of the toxic substances they typically contain. Further, the light intensity of gas discharge lamps tends to decrease over time with use. Additionally, gas discharge lamps typically produce ozone due to high voltage requirements and produce intense ultra-violet light that tends to cause the breakdown of many materials and may lead to gas leakage into the environment. Thus conventional lights have various problems.

Solid state lighting has been developed to overcome some of the problems of incandescent lamps and gas discharge lamps. Solid state lighting (SSL) refers to a type of lighting that utilizes light-emitting diodes (LEDs), organic light-emitting diodes (OLED), or polymer light-emitting diodes (PLED) as sources of illumination rather than electrical filaments or gas. The term "solid state" refers to the fact that light in an LED is emitted from a solid object—a block of semiconductor—rather than from a vacuum or gas tube, as is the case in traditional incandescent light bulbs and fluorescent lamps. The LED is a semiconductor diode that emits incoherent narrow-spectrum light when electrically biased in the forward direction of the p-n junction, as in the common LED circuit resulting in electroluminescence. Unlike incandescent or fluorescent lighting, however, SSL creates visible light with reduced heat generation or parasitic energy dissipation. In addition, its solid-state nature provides for greater resistance to shock, vibration, and wear, thereby increasing its lifespan significantly.

An LED is typically a small area source. The color of the emitted light depends on the composition and condition of the semiconducting material used, and can be infrared, visible, or near-ultraviolet. An LED provides direct light projection where incandescent lamps provide a fan-shape illumination pattern. The disadvantages of the LED are its narrower illuminating angle and difficulty in radiating light uniformly in all directions contrary to the conventional tungsten bulb. The angle of some LEDs has been improved by modifying the structure of the LED bulb.

Many conventional LED devices, however, are limited by thermal energy-management issues. For example, LEDs exhibit negative temperature coefficient aspects. That is, at a fixed power input, as the LED device's operating heat rises, the LED device's light output decreases. High heat during use can shorten the useful life of an LED. It is, however, desirable to run LEDs using high current, because the higher the current, the higher the brightness of the emitted light. Accordingly, there is motivation to manage heat as much as possible in order to operate an LED optimally with regard to power input and light output and LED life.

It remains desirable to have an LED illumination device wherein heat is managed such that lumens, energy consumption and lifespan are maximized.

SUMMARY

The present invention is directed to a light emitting diode illumination device. An object of the present invention is to provide an LED illumination device with a distribution of luminous intensity wherein heat is managed such that the device has a long life and saves energy over conventional lighting.

In a first embodiment of the present invention, a light emitting diode (LED) illumination device provides an arrangement of LEDs spaced from the base of the device. The LEDs are spaced in a staggered vertical arrangement from an electronic substrate such as a printed circuit board. The spacing between the LEDs, which generate heat, and the printed circuit board, which also produces heat in operation, enables the heat to dissipate such that the device can be run efficiently. The passive heat management does not contribute to the energy consumption of the device for cooling purposes. Further, the configuration of LEDs manages heat such that brightness and lifespan are maximized. In addition, the staggered arrangement of LEDs broadens the light projection area of the device.

In an alternative embodiment of the invention, the LEDs are arranged in circles of increasing diameter. This arrangement further increases the distance between LEDs which enhances heat management.

In a further alternative embodiment, the LEDs are angled by bending the leads. The leads have sufficient stiffness to maintain the angle. The angled LEDs provide the illumination device with a broadened illumination angle over untangled LEDs.

Alternative embodiments of the illumination device include a reflective substrate supporting the LEDs. A still further alternative embodiment includes a thermally conductive substrate supporting the LEDs.

The present invention together with the above and other advantages may best be understood from the following detailed description of the embodiments of the invention illustrated in the drawings, wherein:

DRAWINGS

DESCRIPTION

A light emitting diode (LED) illumination device provides an arrangement of LEDs spaced from the base of the device. The LEDs are spaced in a staggered arrangement. The configuration of LEDs manages heat such that brightness and lifespan are maximized. In addition, the arrangement of LEDs broadens the projected area of illumination of the device. An alternative arrangement of the LEDs further broadens the projected area of illumination of the device.

Figure 1:
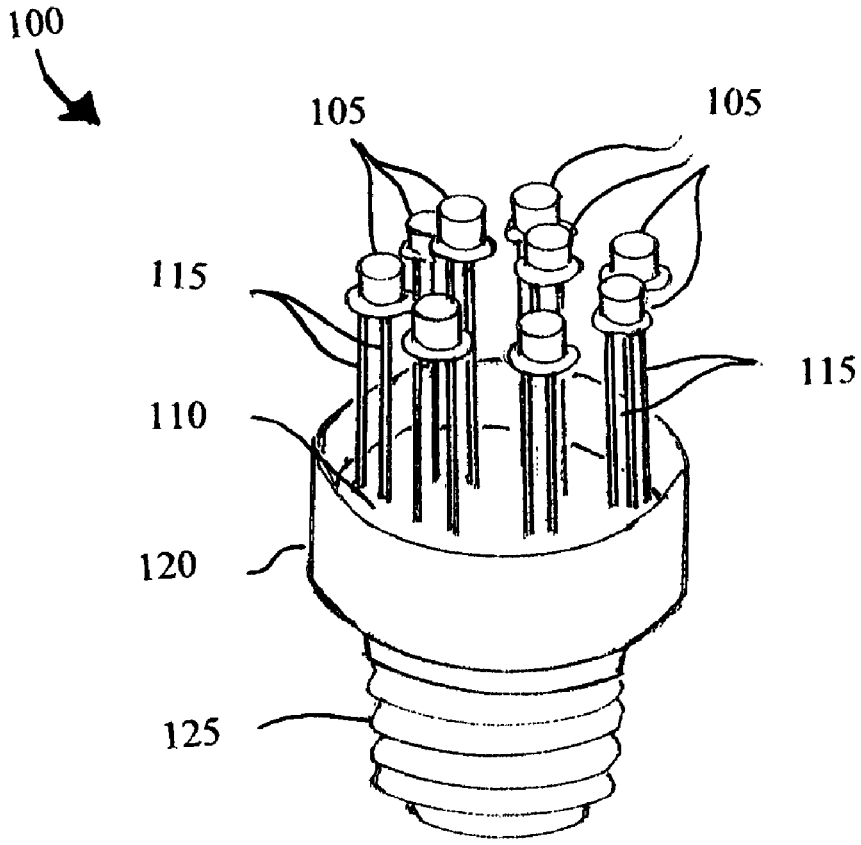
FIG. 1 is a perspective view of an embodiment of the light emitting diode illumination device according to principles of the invention.
Figure 6:
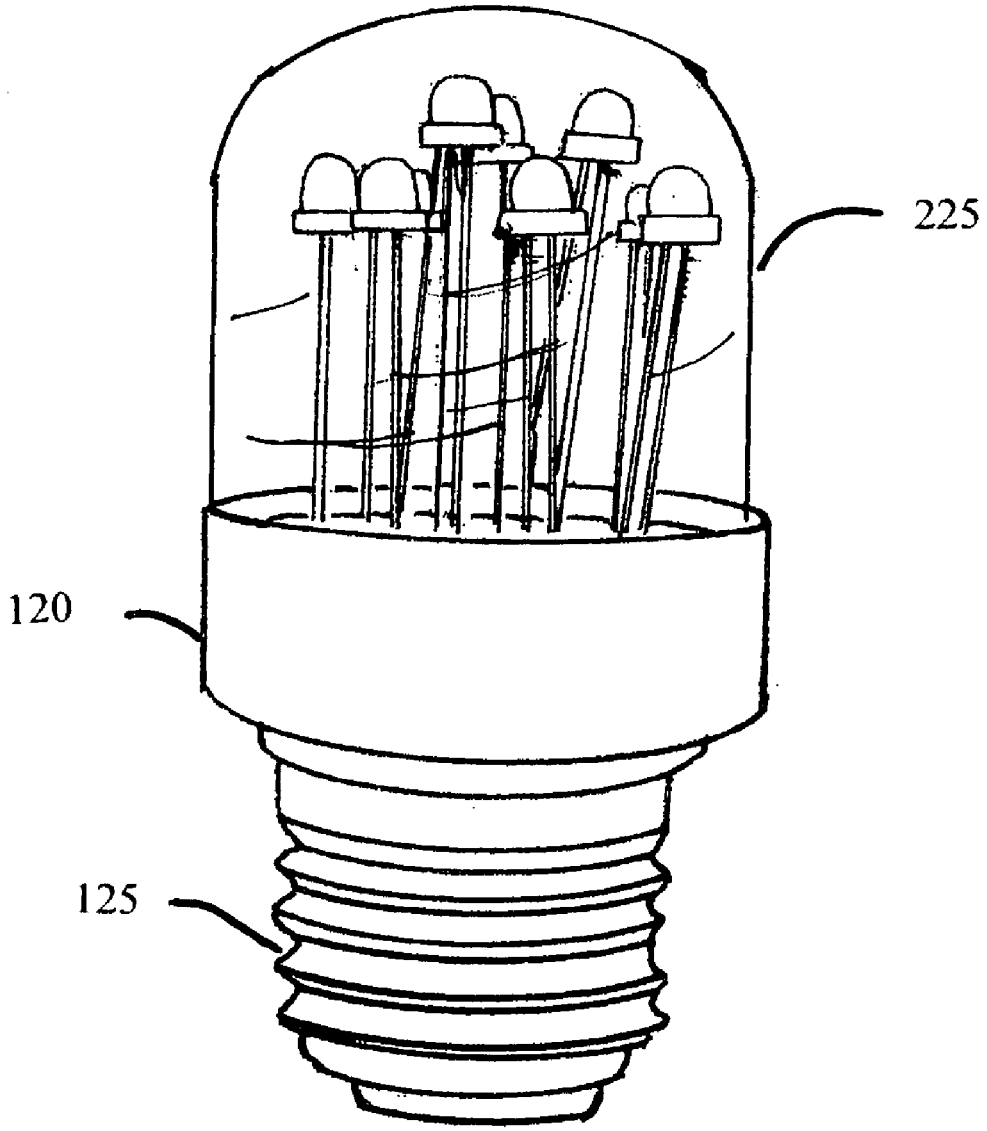
FIG. 6 is a side view of an embodiment of the light emitting diode illumination device having a cover.

FIG. 1 is a perspective view of an embodiment of the LED illumination device 100 of the present invention. A plurality of LEDs 105 is mounted on a substrate 110 with a plurality of conductive wires 115. The substrate 110 is set in a housing 120. Typically, a transparent or translucent cover 225, shown in FIG. 6, encloses the LEDs 105 and couples to the housing 120. A lamp base 125 is attached to the housing 120. One of the advantages of LED-based lighting is its high efficiency, as measured by its light output per unit power input.

The LEDs 105 of the present embodiment are, for example, visible light LEDs. Typical operating currents for LED devices begin at 350 mA. A high efficiency high-power white LED typically operates at a luminous efficacy of 115 lm/W (350 mA). In the present embodiment, each LED 105 is for example a high power LED operating at greater than 1 W of electrical power. Other types of LEDs are possible within the scope of the invention.

Figure 7:
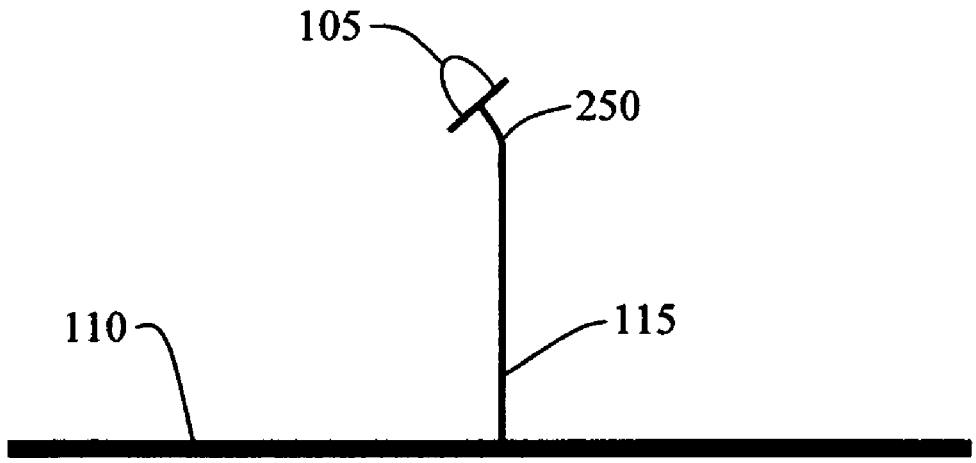
FIG. 7 is a side view of an embodiment of the light emitting diode illumination device having an alternative configuration of LEDs.

The conductive wires have sufficient stiffness to support the LEDs at some distance above the substrate. The conductive wires can be flexed to reposition each LED and can maintain the new position as shown in FIG. 7. The LEDs 105 are distributed over the substrate 110. In the present invention, the LEDs are located on the substrate in a substantially concentric circular arrangement. Many other arrangements of the LEDs on the substrate are possible. Those skilled in the art will understand that the present invention is not limited to the arrangement of LEDs shown in FIG. 1. The conductive wires are varied in length such that the LEDs in the inner circle are further away from the substrate than the LEDs in the outer circle. In all cases, there is a distance between the LED and the substrate. Other arrangements of the LEDs both in the horizontal and vertical planes are possible within the scope of the invention.

The substrate 110 in the present embodiment is a printed circuit board, also known as a printed wiring board. In an alternative embodiment, the substrate is merely a supportive platform and electrical connection from a power source and the LEDs are provided in some other manner such as wiring in the housing. In a first alternative embodiment, the substrate 110 has a reflective top surface to reflect light away from the substrate. The reflective substrate acts to direct light reflected back from the cover shown in FIG. 6 over the LEDs out of the device. A further alternative embodiment has a transparent substrate and the inner surface of the housing is reflective. In a still further alternative embodiment, the substrate is thermally conductive and provides further cooling to the device in addition to the heat management provided by the staggered arrangement of the LEDs.

The lamp base in the present invention is a standard base enabling the device to be inserted into a standard lamp or light fixture. One skilled in the art will understand that other housing and base configurations are possible within the scope of the present invention.

The refractive index of most LED semiconductor materials is typically high, so often the light from the LED is coupled into a much lower-index medium. The large index difference makes the reflection quite substantial (per the Fresnel coefficients). The produced light is therefore partially reflected back into the semiconductor, where the light may be absorbed and turned into additional heat. This effect is usually one of the dominant causes of LED inefficiency. Often more than half of the emitted light is reflected back at the LED-package and package-air interfaces. The reflection is commonly reduced by using a dome-shaped (half-sphere) package with the diode in the center so that the outgoing light rays strike the surface perpendicularly, at which angle the reflection is minimized. Substrates that are transparent to the emitted wavelength, and backed by a reflective layer, increase the LED efficiency. The refractive index of the package material generally matches the index of the semiconductor, to minimize back-reflection. An anti-reflection coating may be added as well. Other strategies for reducing the impact of the interface reflections include designing the LED to reabsorb and reemit the reflected light (referred to as photon recycling) and manipulating the microscopic structure of the surface to reduce the reflectance, by introducing random roughness, creating programmed moth eye surface patterns. Photonic crystal has also been used to minimize back-reflections.

In operation, both the LEDs and the substrate generally produce heat. The LEDs are spaced away from the substrate to enable heat to dissipate. Further, the spacing of the LEDs away from the substrate reduces the heat generated from light reflected back to the substrate thereby reducing cooling needs. Passive heat management allows the LED illumination device to operate with maximum luminosity and lifespan and energy efficiency.

Figure 2:
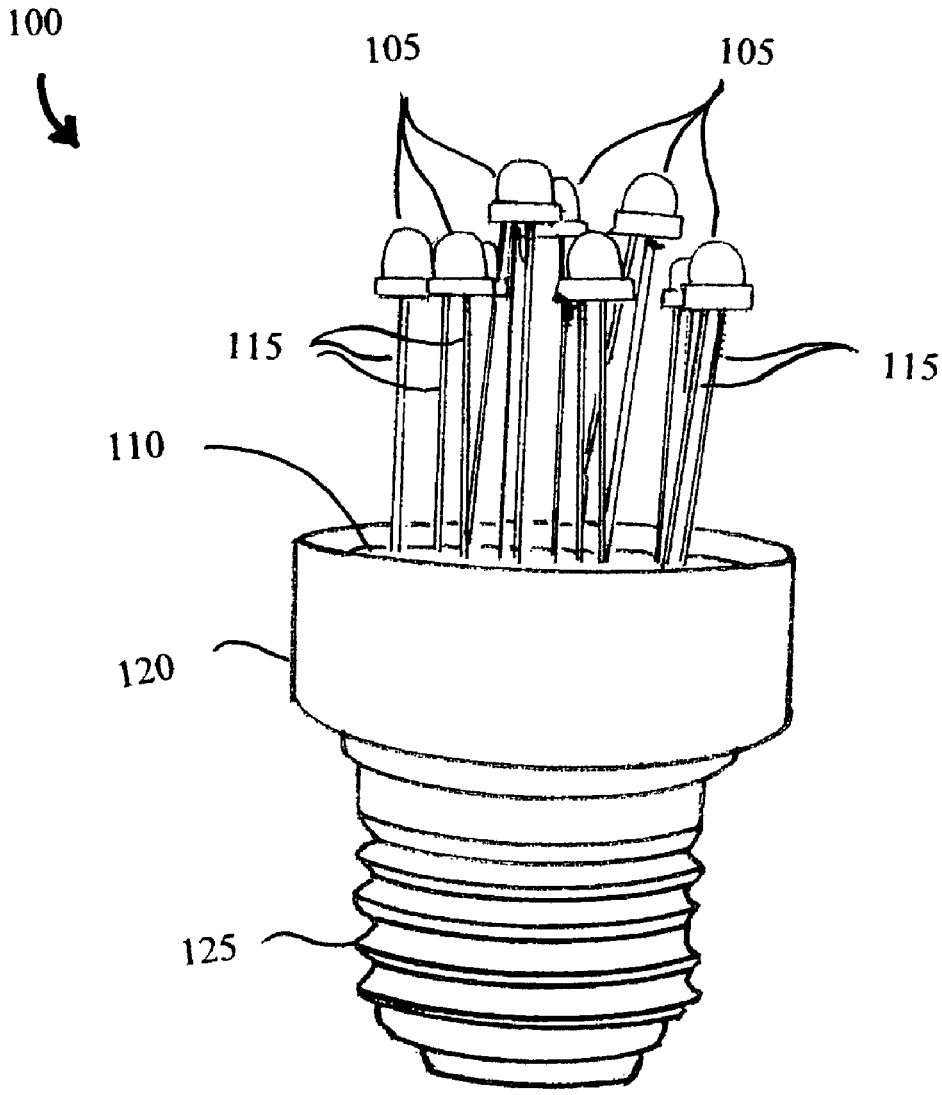
FIG. 2 is a side view of the light emitting diode illumination device of FIG. 1.

FIG. 2 is a side view of the light emitting diode illumination device of FIG. 1. A plurality of LEDs 105 is mounted on a substrate 110 with a plurality of conductive wires 115. The substrate 110 is set in a housing 120. A lamp base 125 is attached to the housing 120. In this view, it can be seen that the spacing between the substrate 110 and the LEDs 105 is varied. One skilled in the art will understand that other arrangements of LEDs are possible within the scope of the invention.

Figure 3:
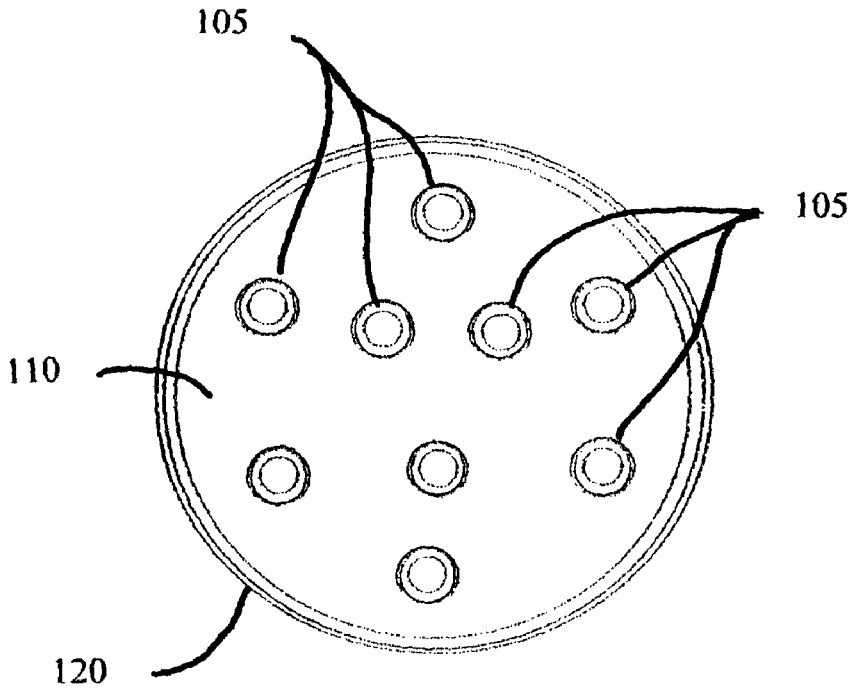
FIG. 3 is a top view of the light emitting diode illumination device of FIG. 1.

FIG. 3 is a top view of the light emitting diode illumination device of FIG. 1. LEDs 105 are positioned on a substrate 110 in a substantially concentric circular arrangement. The substrate 110 is contained in a housing 120. In this view, the spacing between the LEDs 105 in the horizontal plane can be seen. The arrangement of the LEDs in the horizontal plane is such that each LED has a much distance between it and any other LED as possible. The spacing of the LEDs in both the horizontal and vertical planes (described above) enables passive heat dissipation to occur. Thus the bulb as a whole operates at a greater efficiency resulting in a longer lifespan.

Figure 4:
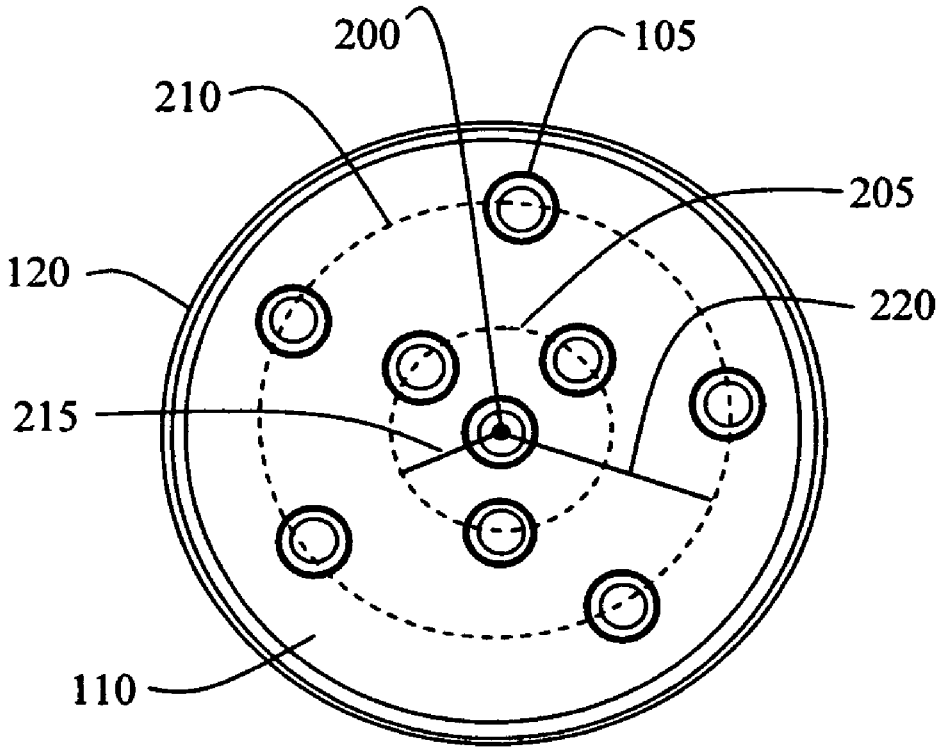
FIG. 4 is a diagram illustrating the horizontal spacing of light emitting diodes in an embodiment of the invention.
Figure 5:
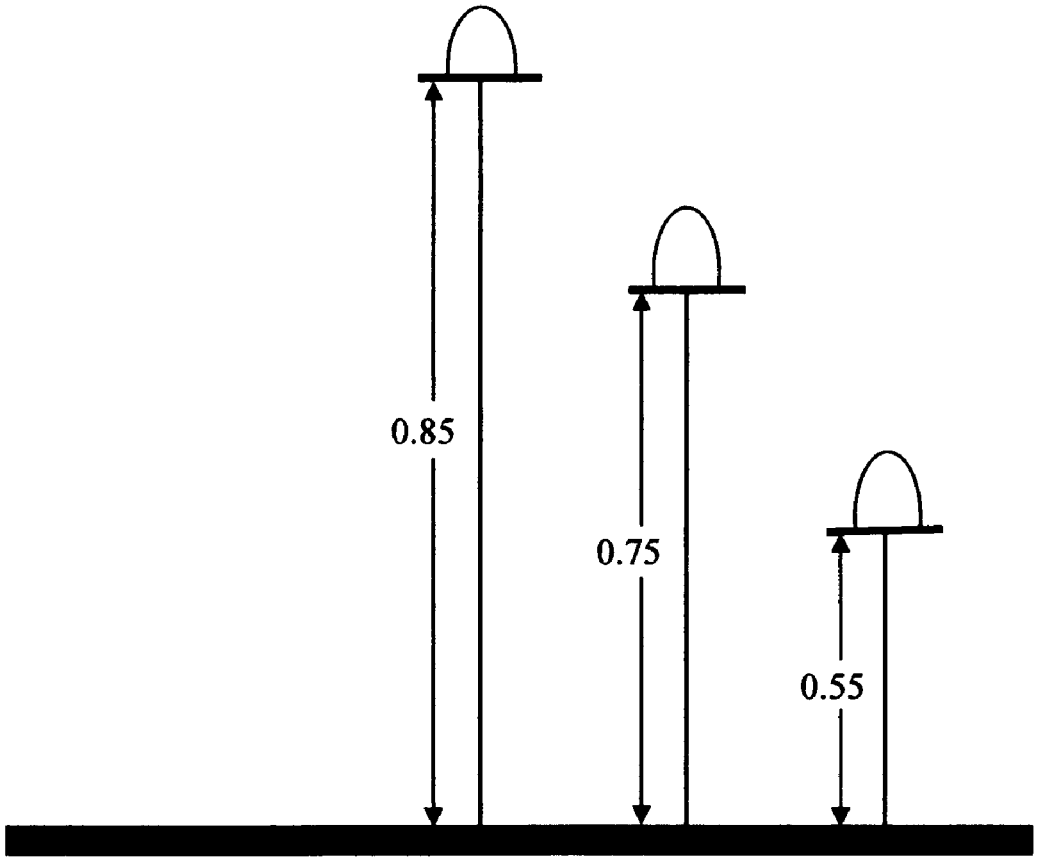
FIG. 5 is a diagram illustrating the vertical spacing of light emitting diodes in an embodiment of the invention.

FIG. 4 is a top view of an alternative embodiment of the light emitting diode illumination device. This embodiment has an alternative arrangement of LEDs. The housing 120 holds the substrate 110. The substrate 110 supports a plurality of LEDs 105. The LEDs are arranged such that one LED is positioned at a center point 200 of two concentric circles 205, 210 (indicated for illustrative purposes only by dotted lines). Three LEDs are positioned in the inner circle 205 and five LEDs are positioned in the outer circle 210. The radius 215 of the inner circle 205 is for example 0.3" and the radius 220 of the outer circle is for example 0.6". As shown in FIG. 5, the distance between the center LED and the substrate 110 is for example 0.85", the distance between the LEDs of the inner circle and the substrate 110 is for example 0.75" and the distance between the LEDs of the outer circle and the substrate 110 is for example 0.55".

FIG. 7 is a side view of an LED 105 with elongated leads 115. The leads 115 are bent such that the LED 105 is angled with respect to the substrate 110. The leads 115 are flexible and have sufficient stiffness to maintain the angle 250. Angling the LEDs of the inner ring 205 and outer ring 210 broadens the angle of illumination of the illumination device.

An LED illumination device provides the luminosity of a conventional incandescent lighting device with greater energy savings than a conventional fluorescent lighting device.

It is to be understood that the above-identified embodiments are simply illustrative of the principles of the invention. Various and other modifications and changes may be made by those skilled in the art which will embody the principles of the invention and fall within the spirit and scope thereof.

We claim:

1. An illumination device, comprising:

a housing configured to form a base for the illumination device;

a substrate set into the housing; and a plurality of light emitting diodes mounted on the substrate, each light emitting diode of the plurality having a pair of elongated leads that support the light emitting diode on the substrate, wherein one light emitting diode of the plurality is mounted at a center point on the substrate and the remaining light emitting diodes of the plurality are arranged in two concentric circles centered on the center point, the two concentric circles forming an inner circle and an outer circle, and wherein the one light emitting diode mounted at the center point is spaced a first distance from the substrate, the light emitting diodes mounted in the inner circle are spaced a second distance from the substrate and the light emitting diodes mounted in the outer circle are spaced a third distance from the substrate, whereby the distances spacing the light emitting diodes of the plurality from the substrate enable cooler operation of the light emitting diodes of the plurality in the illumination device.

2. The illumination device of claim 1 wherein the first distance is greater than the second distance and the second distance is greater than the third distance.

3. The illumination device of claim 1 wherein the first distance is at least 0.85", the second distance is at least 0.75" and the third distance is at least 0.55".

4. The illumination device of claim 1 wherein the light emitting diodes mounted in the inner and outer circles are arranged in a stagger pattern such that horizontal spacing between the light emitting diodes in the inner and outer circles is maximized.

5. The illumination device of claim 1 wherein the inner circle has a radius of at least 0.3" and the outer circle has a radius of at least 0.6".

6. The illumination device of claim 1 wherein the elongated leads are bendable and have sufficient stiffness to maintain a position and wherein the light emitting diodes are angled via bending of the leads such that the overall angle of illumination of the illumination device is enlarged.

7. The illumination device of claim 1 wherein the substrate has a reflective top surface.

8. The illumination device of claim 1 wherein the substrate is thermally conductive.

9. The illumination device of claim 1 wherein the substrate is a printed wiring board.

10. The illumination device of claim 1 wherein the substrate is substantially transparent and wherein an inner surface of the housing is reflective.

11. The illumination device of claim 1 wherein a substantially transparent cover is coupled to the housing and encloses the plurality of light emitting diodes.

12. A light emitting diode bulb, comprising:

a substantially cylindrical housing;

a substantially circular substrate set into the housing;

a plurality of light emitting diodes mounted on the substrate, each light emitting diode of the plurality having a pair of elongated leads that support the light emitting diodes of the plurality on the substrate, wherein one light emitting diode of the plurality is mounted at a center point on the substrate and the remaining light emitting diodes of the plurality are arranged in two concentric circles centered on the center point, the two concentric circles forming an inner circle and an outer circle, wherein the one light emitting diode mounted at the center point is spaced a first distance from the substrate, the light emitting diodes mounted in the inner circle are spaced a second distance from the substrate, and the light emitting diodes mounted in the outer circle are spaced a third distance from the substrate, whereby the distances spacing the light emitting diodes of the plurality from the substrate enable cooler operation of the light emitting diodes of the plurality in the illumination device.

13. The light emitting diode bulb of claim 12 wherein the first distance is greater than the second distance and the second distance is greater than the third distance.

14. The light emitting diode bulb of claim 13 wherein the first distance is at least 0.85", the second distance is at least 0.75" and the third distance is at least 0.55".

15. The light emitting diode bulb of claim 12 wherein the elongated leads are bendable and have sufficient stiffness to maintain a position and wherein the light emitting diodes are angled via bending of the leads such that the overall angle of illumination of the illumination device is enlarged.

* * * * *